US008085208B2

(12) United States Patent
Wallace

(10) Patent No.: US 8,085,208 B2
(45) Date of Patent: Dec. 27, 2011

(54) CONFIGURABLE RADIO FREQUENCY ELEMENT

(75) Inventor: Richard Wallace, Jarfalla (SE)

(73) Assignee: Infineon Technologies AG, Neubiberg (DE)

( * ) Notice: Subject to any disclaimer, the term of this patent is extended or adjusted under 35 U.S.C. 154(b) by 835 days.

(21) Appl. No.: 11/749,154

(22) Filed: May 16, 2007

(65) Prior Publication Data

US 2008/0284672 A1 Nov. 20, 2008

(51) Int. Cl.
*H01Q 9/00* (2006.01)

(52) U.S. Cl. ..... 343/749

(58) Field of Classification Search ..... 343/700 MS, 343/702, 895, 749, 845, 795, 834
See application file for complete search history.

(56) References Cited

U.S. PATENT DOCUMENTS

| | | | | |
|---|---|---|---|---|
| 5,712,641 | A * | 1/1998 | Casabona et al. | 342/362 |
| 6,107,972 | A * | 8/2000 | Seward et al. | 343/722 |
| 7,330,152 | B2 * | 2/2008 | Zhang et al. | 343/700 MS |
| 7,477,194 | B2 * | 1/2009 | Coleman et al. | 343/700 MS |
| 7,492,259 | B2 * | 2/2009 | Cox | 340/572.1 |
| 7,592,961 | B2 * | 9/2009 | Thober et al. | 343/745 |
| 7,640,070 | B2 * | 12/2009 | Chang et al. | 700/110 |
| 2003/0103011 | A1 * | 6/2003 | Rogers et al. | 343/749 |
| 2004/0227678 | A1 * | 11/2004 | Sievenpiper | 343/702 |
| 2006/0187135 | A1 * | 8/2006 | Maniwa et al. | 343/795 |
| 2007/0035466 | A1 * | 2/2007 | Coleman et al. | 343/895 |
| 2007/0252773 | A1 * | 11/2007 | Soler Castany et al. | 343/846 |
| 2008/0224935 | A1 * | 9/2008 | Kato | 343/749 |
| 2008/0238794 | A1 * | 10/2008 | Pan et al. | 343/767 |
| 2009/0127641 | A1 * | 5/2009 | Koyama | 257/428 |

* cited by examiner

*Primary Examiner* — Huedung Mancuso
(74) *Attorney, Agent, or Firm* — Lee & Hayes, PLC

(57) ABSTRACT

Implementations related to configurable strip-line quarter wavelength and/or antenna structures are described herein.

23 Claims, 7 Drawing Sheets

CONFIGURABLE RADIO FREQUENCY ELEMENT

BACKGROUND

Information exchange is generally the economic cornerstone of the diverse societies that span the globe. This has spurned sustained advances in communication technologies, such as wireless communication devices, infrastructure devices related to wireless communications, and protocols used to implement wireless communications.

The advance in communication technologies has resulted in the creation of many different communication standards. Wireless communication systems may operate in accordance with a number of these different communication standards. Some of the more popular communication standards include, advanced mobile phone services (AMPS), digital AMPS, global systems for mobile communications (GSM), code division multiple access (CDMA), and local multi-point distribution system (LMDS).

Many communication technologies and standards operate at different frequencies and bandwidths. For example, GSM may operate in the frequency range of 925 to 960 MHz (receive) and 880 to 915 MHz (transmit). GSM may also operate in the frequency range of 1805 to 1990 MHz (receive) and 1710 to 1910 MHz (transmit). In contrast, CDMA may operate in the frequency range of 824 to 849 MHz (receive) and 869 to 894 MHz (transmit).

Communication technologies that are compatible with several communication standards often use complicated circuitry or technology that increases manufacturing expenditures. In one example, a base station or access point that transmits over diverse frequency ranges may require the implementation of multiple specialized antennas that operate efficiently within those ranges. The costs to design, manufacture and stock such specialized antennas can be significant. To avoid such costs, a wireless device, such as a wireless phone or base station, may be implemented with an antenna that can be tuned to frequencies within a wide frequency band. However, such an antenna often has compromised performance characteristics.

Base stations, access points and other wireless devices may need to operate over a wide frequency range. To enable this requirement, wireless devices may require the use of multiple carriers that each have a desired center frequency. Generally, each one of these multiple carriers requires a uniquely designed strip-line quarter wavelength structure. This requirement dramatically increases the costs associated with developing and producing wireless devices that operate over a wide frequency range.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

At least one or more implementations described herein relate to an antenna having a configurable length. Configuring the length of an antenna may be achieved by way of an antenna structure having radio frequency (RF) lines that are coupled together using one or more electrical components.

In one implementation, a strip or planar antenna may include RF transmission and/or receive lines that may be connected together by way of one or more discrete components. The discrete components are used to establish an effective physical length of the strip or planar antenna.

According to at least one described implementation, an antenna structure is provided that has an RF segment that may be configured to one of a plurality of lengths, depending upon a size (not necessarily physical) and placement of one or more electrically related components between connectable portions of the RF segment. Implementing an antenna in such a way may reduce the number of actual antenna structures required to support a plurality of communication technologies and standards.

According to another described implementation, a strip-line quarter wavelength structure is provided that has a segment that may be configured to one of a plurality of lengths, depending on a size (not necessarily physical) and placement of one or more electrically related components between connectable portions of the segment. Implementing a strip-line quarter wavelength structure in such a way provides a structure that may be used to generate a plurality of diverse center frequencies, depending upon the manner in which the quarter wavelength structure is configured.

The antenna and strip-line quarter wavelength structures according to the implementations described herein may be used as part of printed circuit boards and/or integrated as part of one or more integrated circuits (ICs).

Exemplary Arrangements

Figure 1:
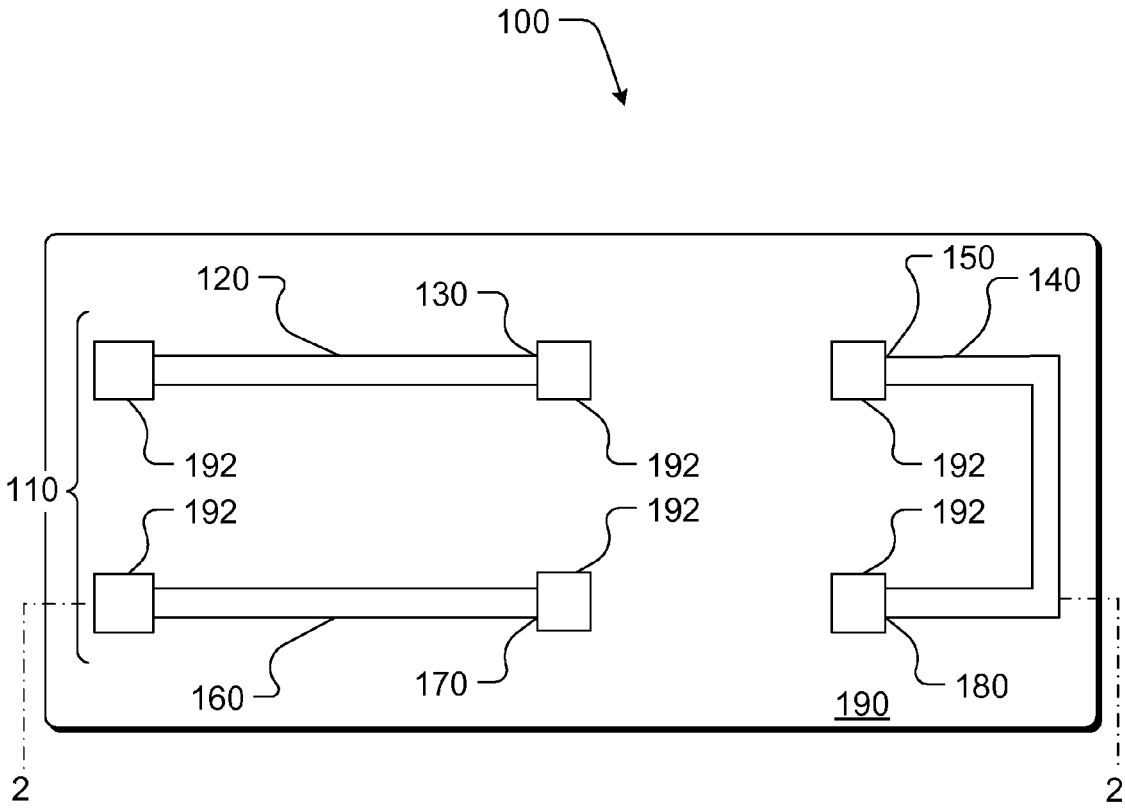
FIG. 1 illustrates an implementation of an antenna structure. The antenna structure has radio frequency (RF) lines that may be coupled together by way of one or more electronic components.

FIG. 1 illustrates an implementation of a structure 100. The structure 100 may be a strip-line quarter wavelength structure usable to produce a particular center frequency depending upon a configuration of the structure 100. Alternatively, the structure 100 may be an antenna structure usable to produce a particular frequency depending on a configuration of the structure 100. In the following, the structure 100 is described as an antenna. However, the same description applies to strip-line quarter wavelength structures.

The antenna structure 100 may include an RF segment 110 that includes a portion 120 having an end 130 that may be coupled to another portion 140. In one implementation, an end 150 of the another portion 140 may be coupled to the end 130 of the portion 120. The RF segment 110 may further include a portion 160 having an end 170 that may be coupled to the another portion 140. In one implementation, an end 180 of the another portion 140 may be coupled to the end 170 of the portion 120. In another implementation, the ends 130 and 170 may be coupled together.

Discrete components may be used to connect the ends 130 and 150 and the ends 170 and 180. Alternatively, a discrete component may be used to connect the ends 130 and 170. Such discrete components include transistors, resistors, capacitors, diodes, and the like. The use of discrete components to connect the ends 130, 150, 170, and 180 may determine an effective length of the RF segment 110.

As those of ordinary skill in the area of RF technologies realize, the effective physical size/length of an antenna generally dictates the antenna's ideal operating frequency bandwidth. Using discrete components, the antenna structure 100 may be designed to have a number of different lengths, which may reduce the number of unique antennas produced to support distinct RF standards.

As is further illustrated in FIG. 1, the antenna structure 100 may be disposed on a circuit board 190. The circuit board 190 may generally be considered a dielectric support structure. The circuit board 190 may include a number of board layers made from different materials. A plurality of contacts 192 may be disposed on the circuit board 190. One or more of the contacts 192 may be vias that enable electrical contact to electrical components associated with one of more of the board layers, and/or external components connectable to the antenna structure 100. The contacts 192 may also facilitate the coupling of discrete components to the antenna structure 100.

Figure 2:
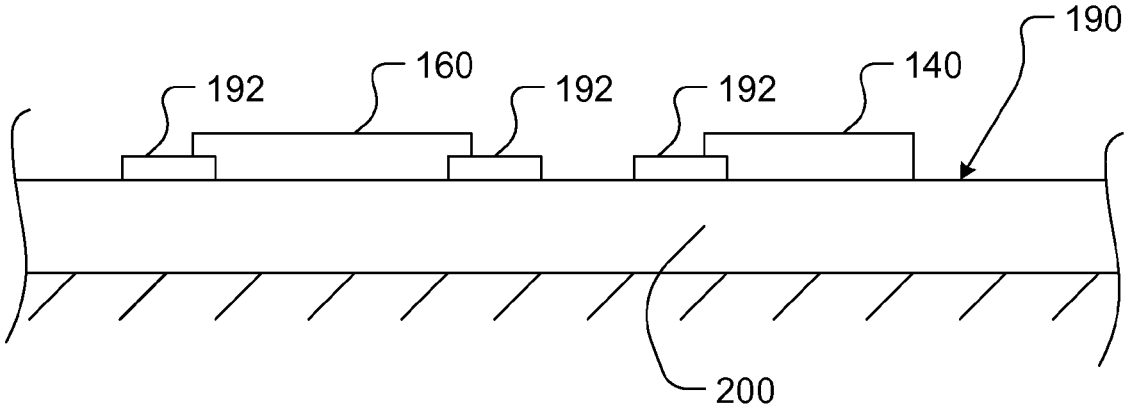
FIG. 2 illustrates a cross-section of the antenna structure illustrated in FIG. 1, taken along dashed lines 2 of FIG. 1.

FIG. 2 illustrates a cross-section of the antenna structure 100, taken along dashed lines 2 of FIG. 1. In the figure, one layer 200 of the circuit board 190 is shown. The contacts 192, the portion 160, and the portion 140 of the RF segment 110 are also illustrated.

In one implementation, the antenna structure 100 illustrated in FIGS. 1 and 2 is a strip-line quarter wavelength antenna that may be used in a variety of wireless communication technologies. A physical length of the antenna structure 100 may be dictated by one or more discrete components utilized to connect at least two of the contacts 192.

Figure 3:
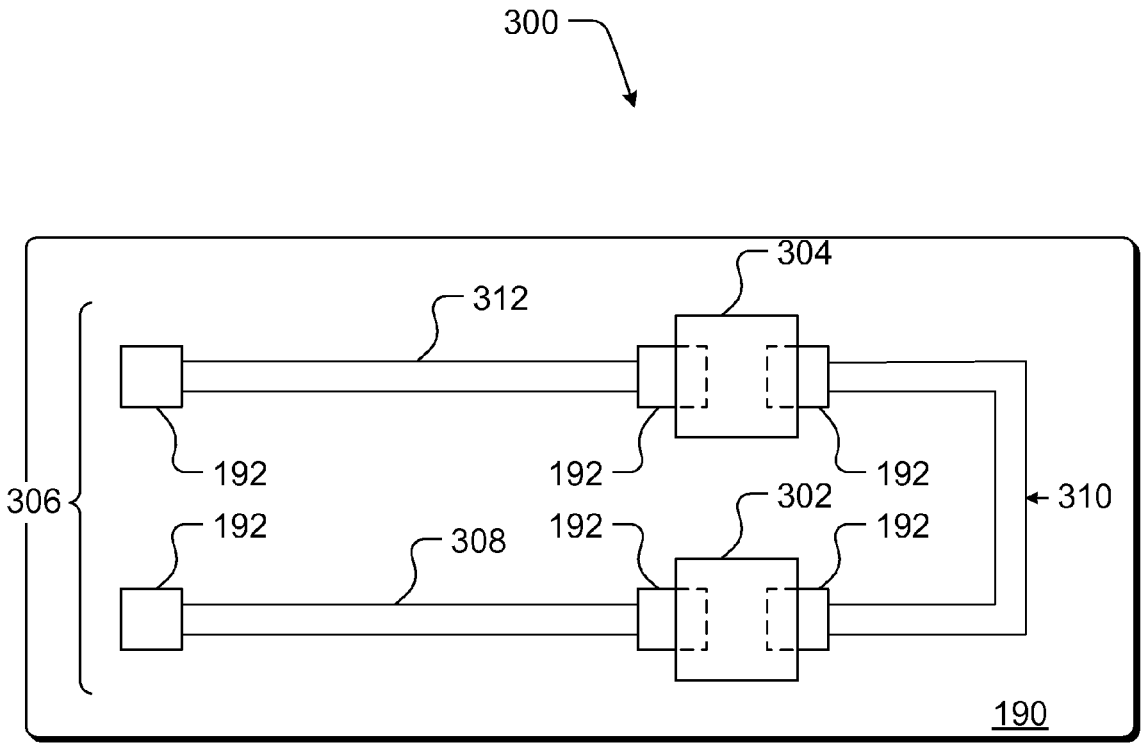
FIG. 3 illustrates an implementation of an antenna structure that may include the use of a first discrete component and a second discrete component. The first and second discrete components connect RF portions of an RF segment associated with the antenna structure.

FIG. 3 illustrates an implementation of a structure 300 that may include the use of a first discrete component 302 and a second discrete component 304. The structure 300 may be a strip-line quarter wavelength structure usable to produce a particular center frequency depending upon a configuration of the structure 300. Alternatively, the structure 300 may be an antenna structure usable to produce a particular frequency depending on a configuration of the structure 300. In the following, the structure 300 is described as an antenna. However, the same description applies to strip-line quarter wavelength structures.

The first and second discrete components 302 and 304 of the antenna structure 300 connect RF portions of an RF segment 306. More specifically, the discrete component 302 couples a portion 308 of the RF segment 306 to another portion 310 of the segment 306. The discrete component 304 couples a portion 312 of the RF segment 306 to the another portion 310 of the segment 306.

The type and composition of the discrete components 302 and 304 may determine the physical length of the antenna structure 300. Therefore, the discrete components 302 and 304 generally influence an ideal operating frequency bandwidth of the RF segment 306. The discrete components 302 and 304 may be a combination of transistors, resistors, capacitors, diodes, and the like.

Figure 4:
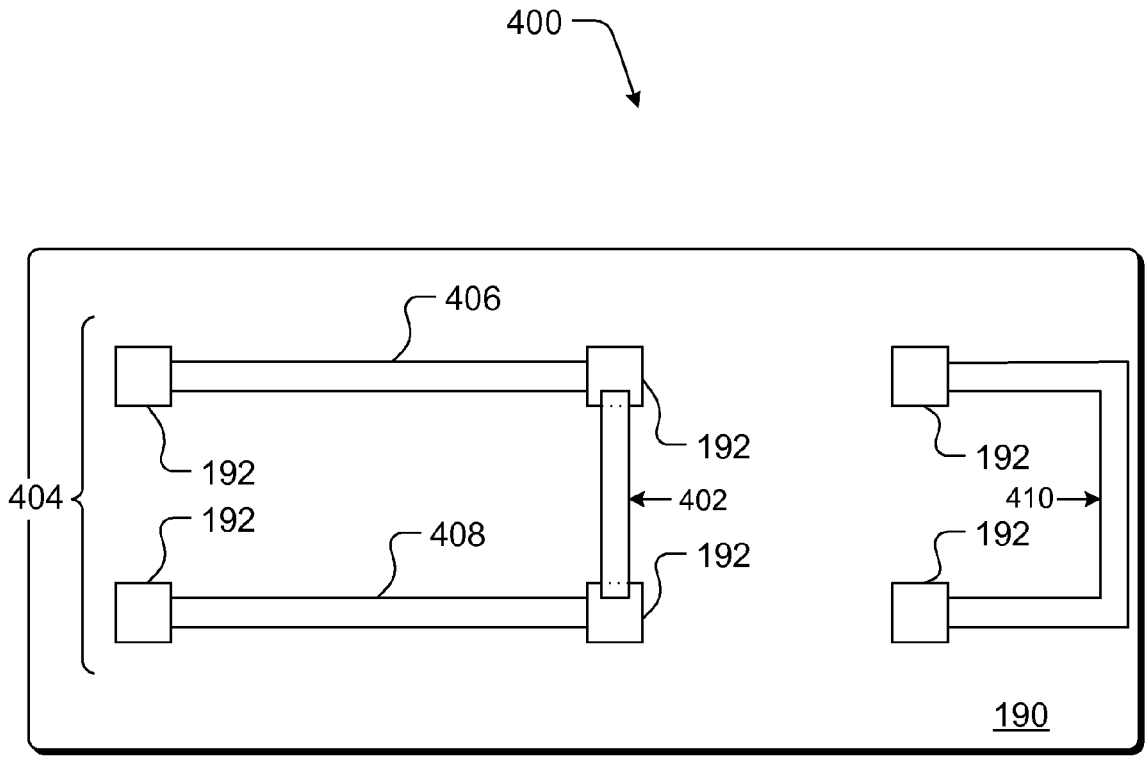
FIG. 4 illustrates another implementation of an antenna structure that may include the use of a discrete component to connect RF portions associated with the antenna structure.

FIG. 4 illustrates an implementation of a structure 400 that may include the use of a discrete component 402. The structure 400 may be a strip-line quarter wavelength structure usable to produce a particular center frequency depending upon a configuration of the structure 400. Alternatively, the structure 300 may be an antenna structure usable to produce a particular frequency depending on a configuration of the structure 400. In the following, the structure 300 is described as an antenna. However, the same description applies to strip-line quarter wavelength structures.

The antenna structure 400 has an RF segment 404 that includes a portion 406 and another portion 408. The discrete component 402 couples the portions 406 and the another portion 408 together. In this implementation, a portion 410 of the RF segment 404 is not used to form an active portion of the RF segment 404.

The type and composition of the discrete component 402 may determine the physical length of RF segment 404. Therefore, the discrete component 402 generally influences an ideal operating frequency bandwidth of the antenna structure 400. The discrete components 402 may be one of a transistor, resistor, capacitor, diode, or the like.

The configurations shown in FIGS. 1-4 are merely illustrative of a select few implementations that may be used to design configurable strip-line quarter wavelength or antenna structures. Those of ordinary skill in the art appreciate many other arrangements may be used to develop the structures illustrated in the figures.

Communication Device

The following discussion describes a communication device that may include structures in accordance with one or more implementations described herein. In portions of the following discussion, reference may be made to the arrangements of FIGS. 1-4.

Figure 5:
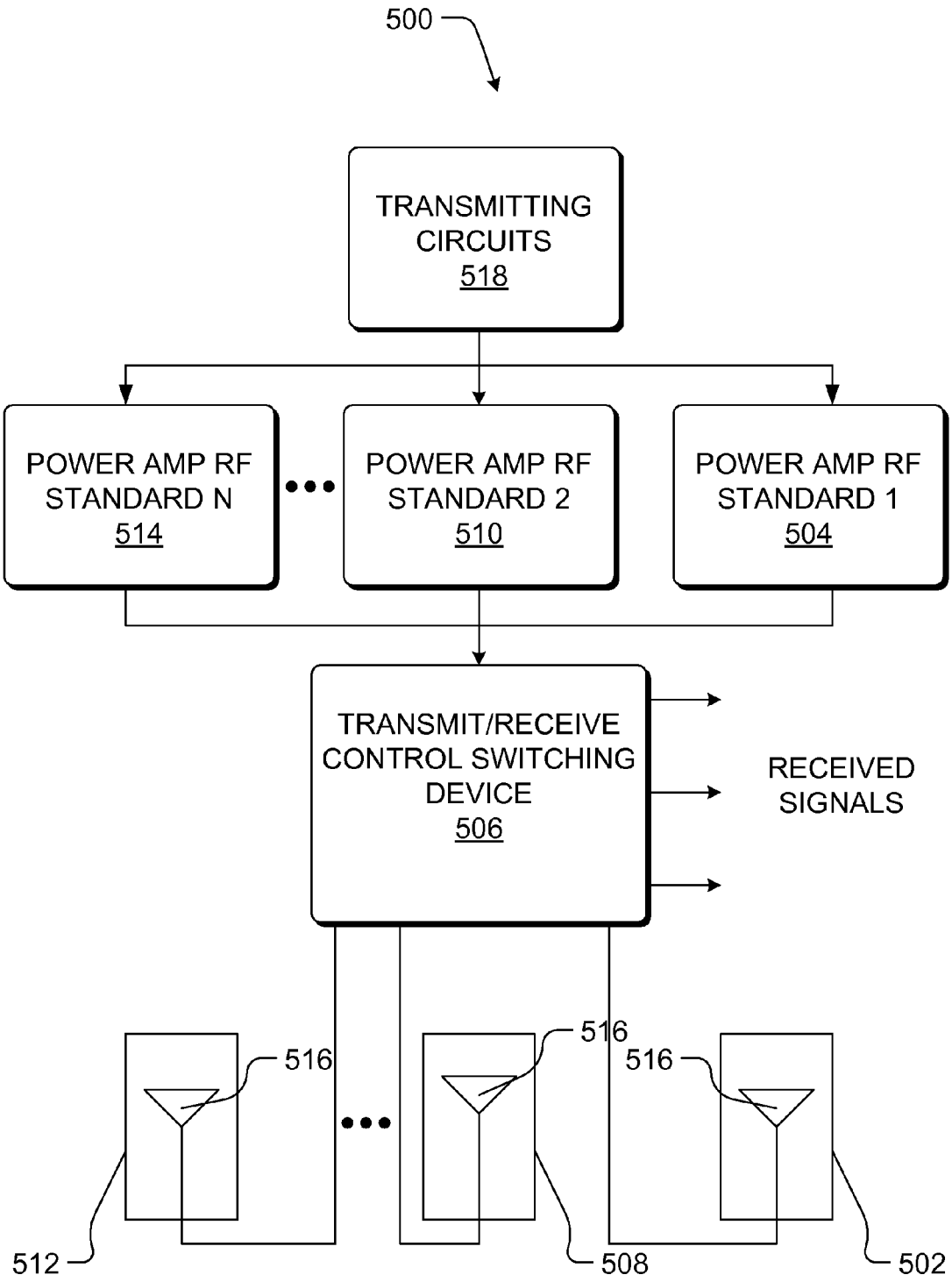
FIG. 5 illustrates elements of a multi-band communication device that may employ the use of a plurality of configurable antenna structures.

FIG. 5 illustrates certain elements of a multi-band communication device 500 capable of operating in both the GSM band of 850/950 MHz, the GSM band of 1800/1900 MHz, and the CDMA band. When operating in the GSM band of 850/950 MHz, a signal to be transmitted is supplied to an antenna 502 though a power amplifier 504 and a properly configured transmit/receive control switch 506. When operating in the GSM band of 1800/1900 MHz, a signal to be transmitted is supplied to an antenna 508 through a power amplifier 510 and a different configuration of the transmit/receive control switch 506. And when operating in the CDMA band, a signal to be transmitted is supplied to an antenna 512 through a power amplifier 514 and yet a different configuration of the transmit/receive control switch 506.

Each antenna 502, 508 and 512 may include an RF structure 516 for radiating RF signals. The multi-band communication device 500 may also include various other transmitting circuits 518, such as signal modulators and demodulators, processing technologies, and the like.

The antennas 502, 508 and 512 may be frequency band tuned using an antenna structures similar to those illustrated in FIGS. 1-4. More specifically, an antenna for use in a desired frequency band may be realized using one or more discrete components implemented on a circuit board having a configurable antenna structure.

Although the foregoing is described in conjunction with a communication device operating in one of the GSM bands and the CDMA band, the teachings herein are also applicable to other communication standards, such as EGSM, WCDMA, DCS, and PCS.

Communication Arrangement

The following discussion describes a communication arrangement that may include antenna structures in accordance with one or more implementations described herein. In portions of the following discussion, reference may be made to the arrangements of FIGS. 1-4.

Figure 6:
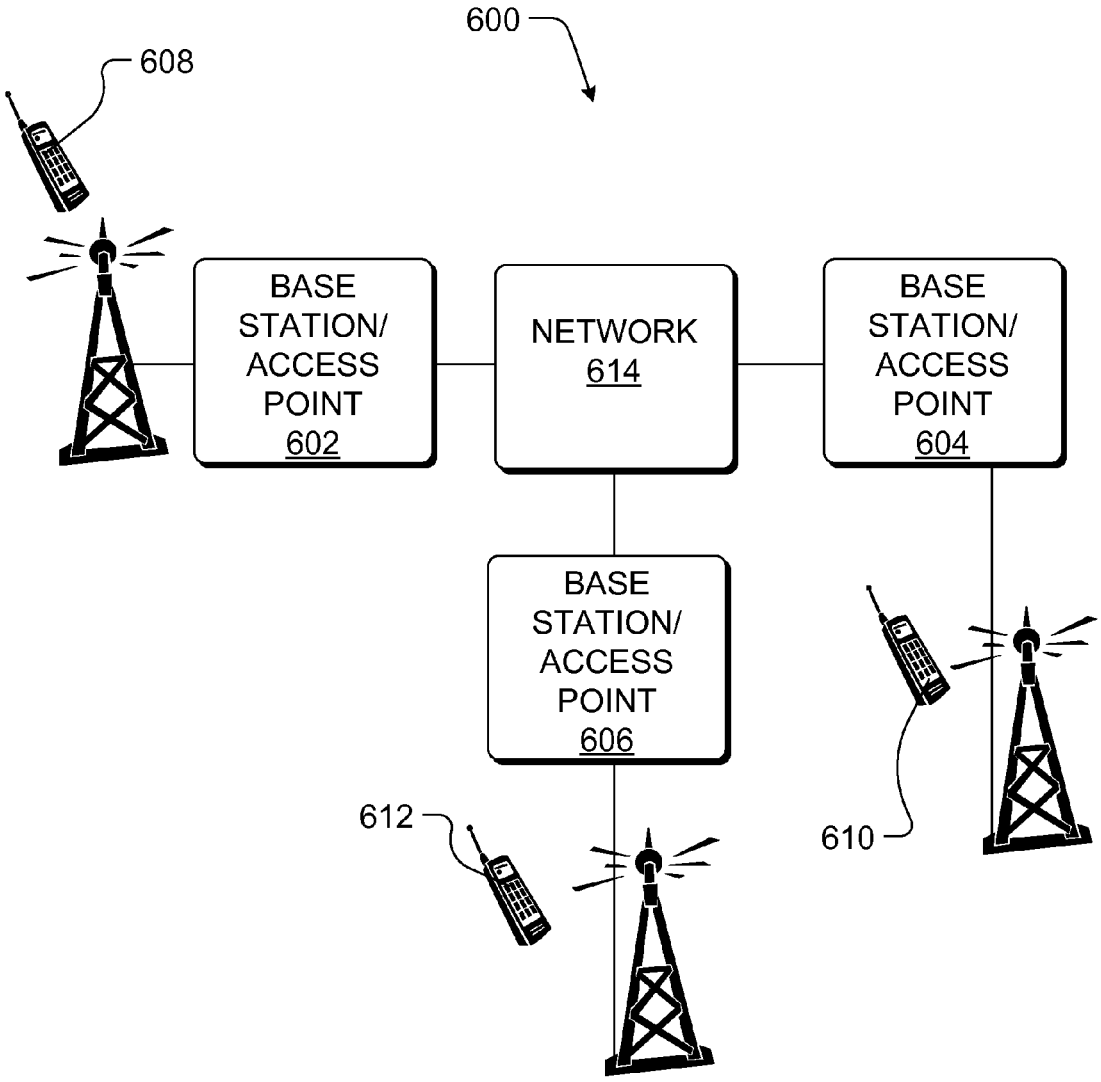
FIG. 6 is a block diagram illustrating a communication system that includes a plurality of base stations and/or access points, a plurality of wireless communication devices and a network hardware component. Various devices in the figure may employ configurable antenna structures.

FIG. 6 is a block diagram illustrating a communication system 600 that includes a plurality of base stations and/or access points 602-606, a plurality of wireless communication devices 608-612 and a network hardware component 614. The wireless communication devices 608-612 may be wireless phones, laptop computers, personal digital assistants, personal computers and/or other wireless communication devices. The base stations and/or access points 602-606 and the plurality of wireless communication devices 608-612 may include communication architecture similar to that illustrated and described in connection with FIG. 5.

The base stations or access points 602-606 may be operably coupled to the network hardware 614 via local area network connections. The network hardware 614, which may be a router, switch, bridge, modem, system controller, and so forth, provides a wide area network connection for the communication system 600. Each of the base stations or access points 602-606 has an associated antenna or plurality of antennas to communicate with the wireless communication devices 608-612 in its area. Similarly, each of the wireless communication devices 608-612 has an associated antenna or plurality of antennas to communicate with the base stations or access points 602-606. The antennas associated with the base stations or access points 602-606 and the wireless communication devices 608-612 may be of the type illustrated and described in connection with FIG. 1-5.

Typically, base stations are used for wireless telephone systems and like-type systems, while access points are used for in-home or in-building wireless networks. Portable wireless devices are used to communicate with these systems. Regardless of the particular type of communication system and/or device, each wireless communication device includes at least one antenna, and often a plurality of antennas in order to support multiple communication technologies and standards. The antenna structures described herein may reduce the costs associated with equipping these wireless systems by providing antenna structures that are easily tailored to the various operational frequency bandwidths employed by the communication technologies and standards.

Procedure

The following discussion describes procedures that may be implemented utilizing the previously described implementations. Aspects of the procedures may be implemented in hardware, firmware, or software, or a combination thereof. The procedures are shown as a set of blocks that specify operations performed by one or more devices, and are not necessarily limited to the order shown for performing the operations by the respective blocks. In portions of the following discussion, reference may be made to the arrangements of FIGS. 1-6.

Figure 7:
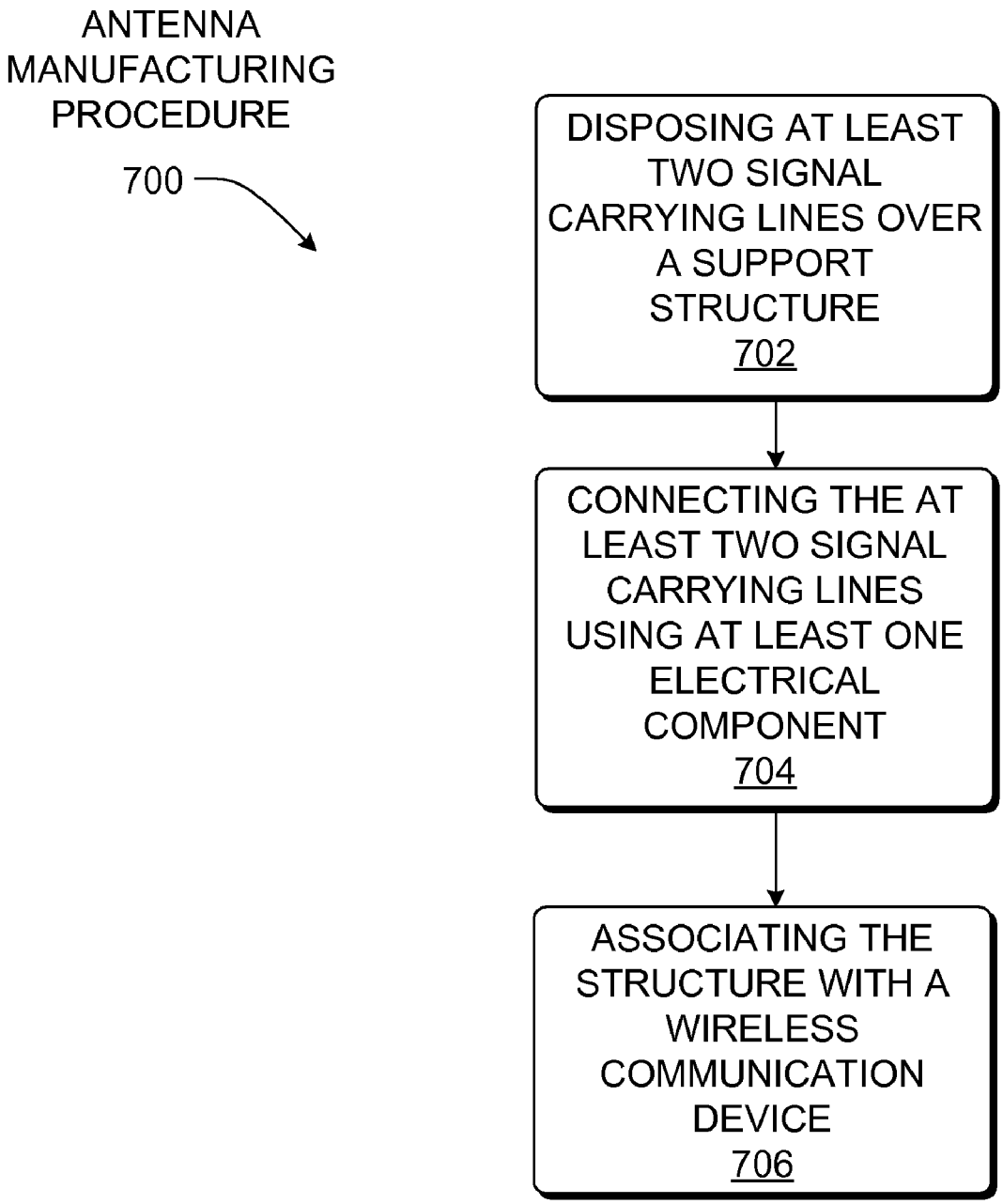
FIG. 7 shows an example procedure for manufacturing a configurable antenna structure.

FIG. 7 shows an example procedure 700 for manufacturing a configurable strip-line quarter wavelength structure and/or an antenna structure. Such a manufactured configurable strip-line quarter wavelength structure and/or an antenna structure may be similar to those illustrated and described in connection with FIGS. 1-4.

At block 702, at least two signal carrying lines are disposed over a support structure. The signal carrying lines may be planar or strip-line related structures. The support structure may be a circuit board that is adapted to include integrated planar or strip-line structures. Alternatively, the planar or strip-line structures may be incorporated as part of an IC. The support structure may include contacts and/or vias that allow the structure to be connected to a wireless communications device. The signal carrying lines may also interface with contacts associated with the support structure. Three signal carrying lines may be disposed over the support structure as well. A first of the signal carrying lines may be interfaced with an end of a third signal carrying line; and a second of the signal carrying lines may be interfaced with another end of the third signal carrying line. The interfacing is made possible through the use of discrete electrical components.

At block 704, the at least two signal carrying lines are connected together using at least one electrical component. Such an electrical component may be a discrete component being one of a resistor, capacitor, diode, or transistor.

At block 706, the support structure with the connected signal carrying lines is associated with a wireless communications device.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as example forms of implementing the claims.

What is claimed is:

1. An antenna structure, comprising:

a first antenna structure portion; and a second antenna structure portion separate from the first antenna structure portion, the second antenna structure portion being connectable to the first antenna structure portion or a third antenna structure portion by way of at least one electrical component to at least partially define a physical length of an antenna, an end of the second antenna structure portion being connectable to an end of the first antenna structure portion to provide a first configuration of the antenna structure or the end of the second antenna structure portion being directly connectable to an end of the third antenna structure portion to provide a second configuration of the antenna structure.

2. The antenna structure according to claim 1, wherein a first end of the third antenna structure portion is connectable to the first antenna structure portion and a second end of the third antenna structure portion is connectable to the second antenna structure portion.

3. The antenna structure according to claim 2, wherein the first end of the third antenna structure portion is connectable to the first antenna structure portion by way of a first electrical component, and the second end of the third antenna structure portion is connectable to the second antenna structure portion by way of a second electrical component.

4. The antenna structure according to claim 3, wherein each of the electrical components is a discrete electrical component.

5. The antenna structure according to claim 3, wherein each of the electrical components is a discrete electrical component, each discrete electrical component being one of a resistor, capacitor, diode and transistor.

6. The antenna structure according to claim 1, wherein a discrete electrical component connects the first and second antenna structure portions, the connected first and second antenna structure portions defining a radio frequency (RF) line of the antenna structure.

7. The antenna structure according to claim 6, the discrete electrical component is one of a resistor, capacitor, diode and transistor.

8. The antenna structure according to claim 1, wherein the first antenna structure portion is connectable to the second antenna structure portion by way of two electrical components.

9. The antenna structure according to claim 8, wherein the two electrical components are each discrete electrical components.

10. The antenna structure according to claim 9, each of the discrete electrical components is one of a resistor, capacitor, diode and transistor.

11. A base station for use in a communication arrangement, the base station comprising at least one antenna structure in accordance with claim 1.

12. A base station for use in a communication arrangement, the base station comprising a plurality of antenna structures in accordance with claim 1.

13. The antenna structure according to claim 1, wherein the first and second antenna structure portions are strip-line radio frequency (RF) carriers associated with a quarter wavelength antenna structure.

14. The antenna structure according to claim 13, wherein the strip-line RF carriers are disposed on a circuit board.

15. An antenna manufacturing method, comprising:

disposing at least three separate signal carrying lines over a support structure, at least two of the three signal carrying lines being connectable using at least one electrical component to complete a signal carrying line of an antenna structure, an end of a first signal carrying line being connectable to an end of a second signal carrying line or being directly connectable to an end of a third signal carrying line.

16. The method according to claim 15, further comprising connecting an electrical component to the first signal carrying line and further connecting the electrical component to the second signal carrying line to carry radio frequency (RF) signals.

17. The method according to claim 16, wherein the electrical component is a discrete component, the discrete component being one of a resistor, capacitor, diode and transistor.

18. The method according to claim 15, wherein the first signal carrying line and the second signal carrying line are individually connectable to the third signal carrying line using an electrical component to complete the signal carrying line of the antenna structure.

19. A strip-line quarter wavelength structure, comprising:

a first structure portion;

a second structure portion separate from the first structure portion, the second structure portion being connectable to the first structure portion by way of at least one electrical component to at least partially define a physical length of the strip-line quarter wavelength structure; and a third structure portion having a first end and a second end, the first end being connectable to the first structure portion and the second end being connectable to the second structure portion.

20. The strip-line quarter wavelength structure according to 19, wherein the first end is connectable to the first structure portion by way of a first electrical component, and the second end is connectable to the second structure portion by way of a second electrical component.

21. The strip-line quarter wavelength structure according to claim 20, wherein each of the electrical components is a discrete electrical component.

22. A printed circuit board for use in a communication arrangement, the printed circuit board comprising at least one strip-line quarter wavelength structure according to claim 19.

23. A strip-line quarter wavelength structure manufacturing method, comprising:

disposing at least two separate signal carrying lines over a support structure, the at least two signal carrying lines being connectable using at least one electrical component to complete a signal carrying line of a strip-line quarter wavelength structure;

connecting a first electrical component to a first signal carrying line of the at least two separate signal carrying lines and further connecting the first electrical component to a second signal carrying line of the at least two separate signal carrying lines; and connecting a second electrical component to a third signal carrying line of the at least two separate signal carrying lines and further connecting the second electrical component to the first signal carrying line or the second signal carrying line, the first signal carrying line, the second signal carrying line, and the third signal carrying line being connected to carry radio frequency (RF) signals.

* * * * *